US009056389B2

(12) United States Patent
Buchanan

(10) Patent No.: US 9,056,389 B2
(45) Date of Patent: Jun. 16, 2015

(54) LINE WRENCHES

(76) Inventor: Nigel A. Buchanan, Fife (GB)

( * ) Notice: Subject to any disclaimer, the term of this patent is extended or adjusted under 35 U.S.C. 154(b) by 756 days.

(21) Appl. No.: 13/056,747

(22) PCT Filed: Jul. 31, 2009

(86) PCT No.: PCT/GB2009/001889

§ 371 (c)(1),
(2), (4) Date: Jan. 31, 2011

(87) PCT Pub. No.: WO2010/013014

PCT Pub. Date: Feb. 4, 2010

(65) Prior Publication Data

US 2011/0126677 A1 Jun. 2, 2011

(30) Foreign Application Priority Data

Jul. 31, 2008 (GB) ..... 0814014.7

(51) Int. Cl.

| | |
|---|---|
| ***B25B 13/00*** | (2006.01) |
| ***B25B 13/48*** | (2006.01) |
| ***B25B 13/46*** | (2006.01) |
| ***B25B 13/52*** | (2006.01) |

(52) U.S. Cl.

CPC ..... *B25B 13/461* (2013.01); *B25B 13/48* (2013.01); *B25B 13/462* (2013.01); *B25B 13/481* (2013.01); *B25B 13/52* (2013.01)

(58) Field of Classification Search

CPC ..... B25B 13/48; B25B 13/065; B25B 13/463
USPC ..... 81/124.2, 60, 121.1, 98, 124.3
See application file for complete search history.

(56) References Cited

U.S. PATENT DOCUMENTS

| | | | | |
|---|---|---|---|---|
| 1,177,620 | A * | 4/1916 | Hardeman | 81/98 |
| 2,522,428 | A * | 9/1950 | Brunstad | 81/121.1 |
| 2,656,750 | A * | 10/1953 | Rasco | 81/124.3 |

(Continued)

FOREIGN PATENT DOCUMENTS

| | | |
|---|---|---|
| DE | 584592 | 9/1933 |
| GB | 2398033 | 8/2004 |

(Continued)

OTHER PUBLICATIONS

International Search Report and Written Opinion of corresponding PCT Application No. PCT/GB2009/001889.

*Primary Examiner* — Monica Carter
*Assistant Examiner* — Danny Hong
(74) *Attorney, Agent, or Firm* — Gardner, Linn, Burkhart & Flory, LLP

(57) ABSTRACT

A line wrench includes a drive receiving portion, a holder movably connected to the drive receiving portion and a fastener engaging body. The fastener engaging body has a plurality of fastener engaging surfaces defined by a fastener receiving aperture having an axis and a side opening through which an elongate member can enter the fastener receiving aperture by a movement transverse to the fastener receiving aperture axis. The holder is arranged to receive the fastener engaging body, has a free end portion and is movable between a position in which the free end portion is spaced from the drive receiving portion to permit an elongate member to enter the side opening and a position in which the free end portion engages the drive receiving portion such that a drive force applied to the drive receiving portion is transmitted to the holder via the free end portion.

14 Claims, 6 Drawing Sheets

(56) References Cited

U.S. PATENT DOCUMENTS

| | | | | | |
|---|---|---|---|---|---|
| 3,661,041 | A | * | 5/1972 | Welz | 81/98 |
| 3,741,047 | A | * | 6/1973 | Kanowsky | 81/124.3 |
| 4,130,032 | A | | 12/1978 | Giandomenico et al. | |
| 4,967,612 | A | * | 11/1990 | Sparling | 81/64 |
| 5,131,300 | A | * | 7/1992 | Daniel | 81/111 |
| 5,339,710 | A | * | 8/1994 | Deadmond et al. | 81/57.3 |
| 5,549,022 | A | * | 8/1996 | Knox | 81/124.2 |
| 5,996,445 | A | * | 12/1999 | Wiens et al. | 81/111 |
| 6,799,492 | B2 | * | 10/2004 | Pearson | 81/58 |

FOREIGN PATENT DOCUMENTS

| | | |
|---|---|---|
| WO | 00/58057 | 10/2000 |
| WO | 03/035327 | 5/2003 |
| WO | 03/037568 | 5/2003 |

* cited by examiner

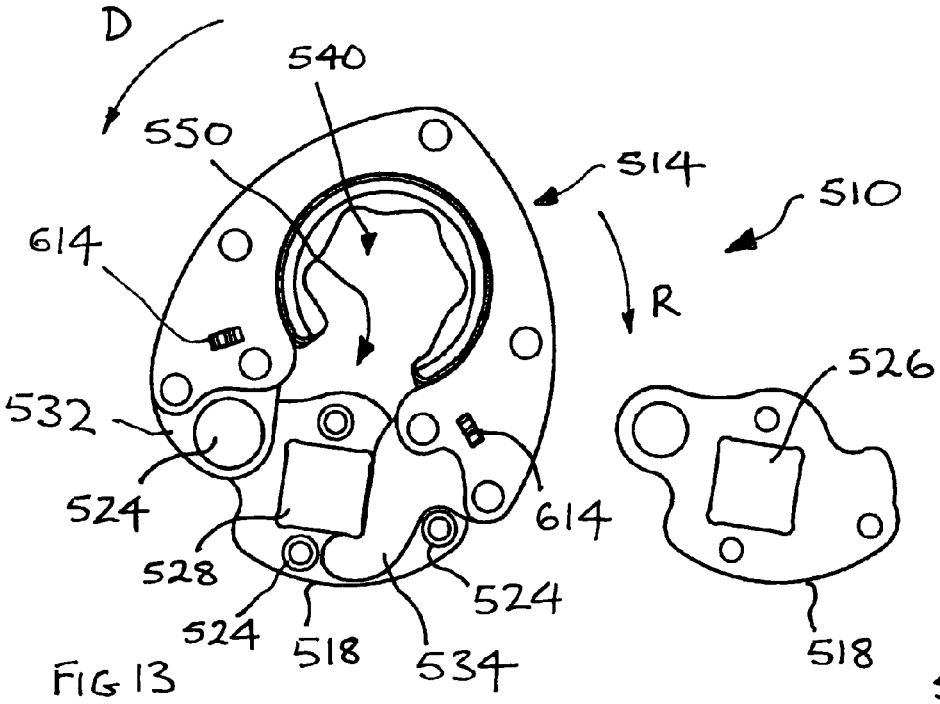
FIG 13
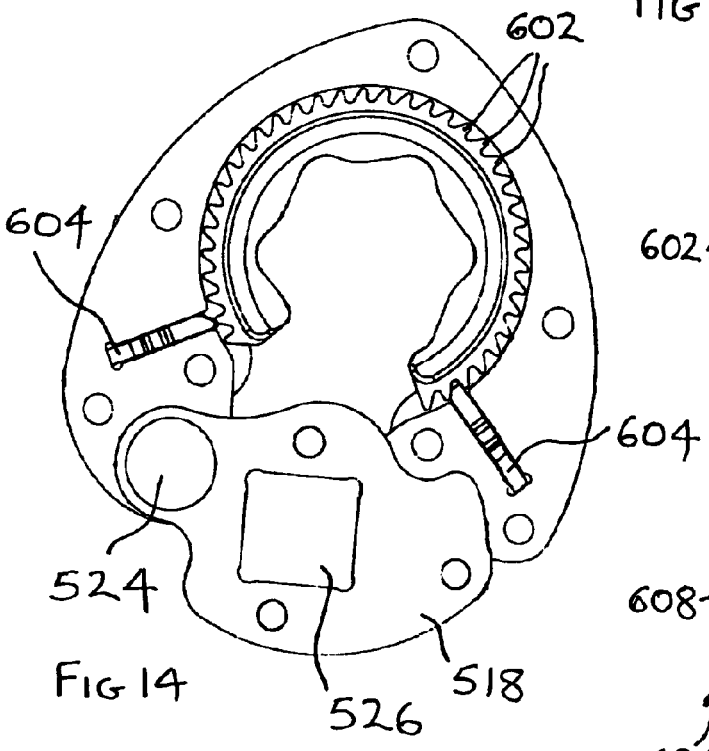
FIG 14
FIG 15
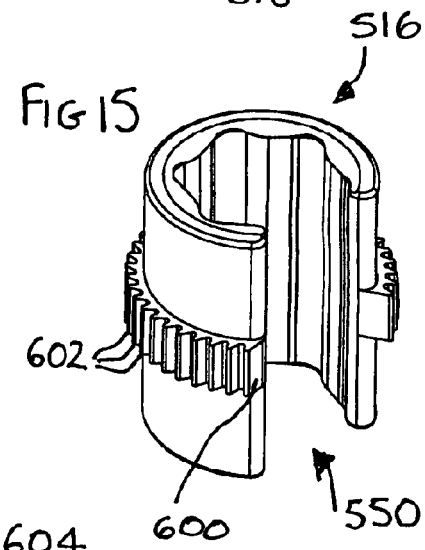
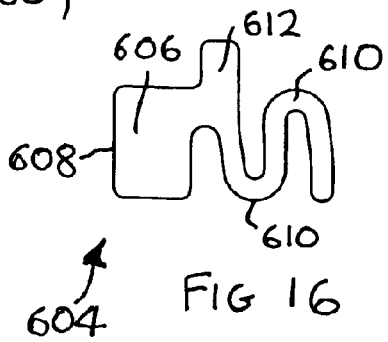
FIG 16

LINE WRENCHES

FIELD OF THE INVENTION

The invention relates to line wrenches.

BACKGROUND TO THE INVENTION

Line wrenches are designed to operate on fasteners that are fitted to an elongate member, such as a pipe, electric cable or the like. For example, line wrenches are used to operate flare nuts that are fitted on fuel and hydraulic pipes and serve to secure the pipe to a metering unit of a fuel injection system or a hydraulic unit such as a hydraulic valve block or brake unit.

The obstruction provided by the elongate member makes it impossible to engage a fastener fitted on the member using a conventional box wrench, socket wrench or ring wrench. Conventional open-ended wrenches and crowfoot wrenches (see U.S. Pat. No. 2,600,617 or U.S. Pat. No. 6,805,029) can be used on such fasteners. However, they will usually only engage two surfaces of the fastener and so are prone to slippage when a large amount of torque needs to be applied. This can result in damage to the fastener, most likely rounding of the drive receiving surfaces and such damage can make it impossible to operate the fastener with an open-ended wrench. This is a problem often encountered when operating the flare nuts used to secure brake lines to brake units in automobile braking systems.

One known form of line wrench comprises a handle with a fixed socket head at one end. The socket head has a conventional hexagonal fastener receiving aperture, except that a side opening generally opposite the handle so that the fastener engaging faces of the fastener receiving aperture opposite the handle do not meet. Unlike an open ended wrench or crowfoot wrench, the side opening a line wrench has a width less than the across flats width of the fastener engaging aperture. Thus, the line wrench cannot be fitted directly onto a fastener by passing the fastener through the side opening and into the fastener receiving aperture. Instead, the line wrench is fitted over the fastener by first moving the wrench transversely of the elongate member associated with the fastener such that the elongate member passes through the side opening. The line wrench is then moved generally axially along the elongate member so that the fastener enters the fastener receiving aperture with its axis of rotation generally in line with the axis of the fastener receiving aperture. This conventional line wrench can be considered a hybrid of a conventional ring wrench and open ended wrench.

In common with other forms of wrench that have a side opening, these conventional line wrenches may spread when heavily loaded, leading to slippage and damage to the fastener. Also, because they need to be a stiff as possible so as to reduce the likelihood of spreading and must be made to exactly fit a particular size of fastener, for workshops and the like it is necessary to keep many different sizes of line wrench to fit the various sizes of fastener that may need to be operated. A further disadvantage of these known line wrenches is that they may be difficult, or impossible, to use in confined spaces or where a plurality of fasteners are grouped close together as, for example, on a metering unit of a fuel injection system.

SUMMARY OF THE INVENTION

The invention provides a line wrench as claimed in claim 1, 10 or 13.

BRIEF DESCRIPTION OF THE DRAWINGS

In order that the invention may be well understood, some embodiments thereof, which are given by way of example only, will now be described with reference to the drawings in which:

FIG. 13 is a plan view of the line wrench of FIG. 12 in a closed condition and with a part removed to show features of the line wrench;

FIG. 14 is a plan view corresponding generally to FIG. 13 but with a different part removed to show other features of the line wrench;

FIG. 15 is a perspective view of a fastener engaging body of the line wrench of FIG. 12; and FIG. 16 shows a side elevation of a part of a ratchet mechanism of the line wrench of FIG. 12.

DETAILED DESCRIPTION OF THE ILLUSTRATED EMBODIMENTS

Figure 1:
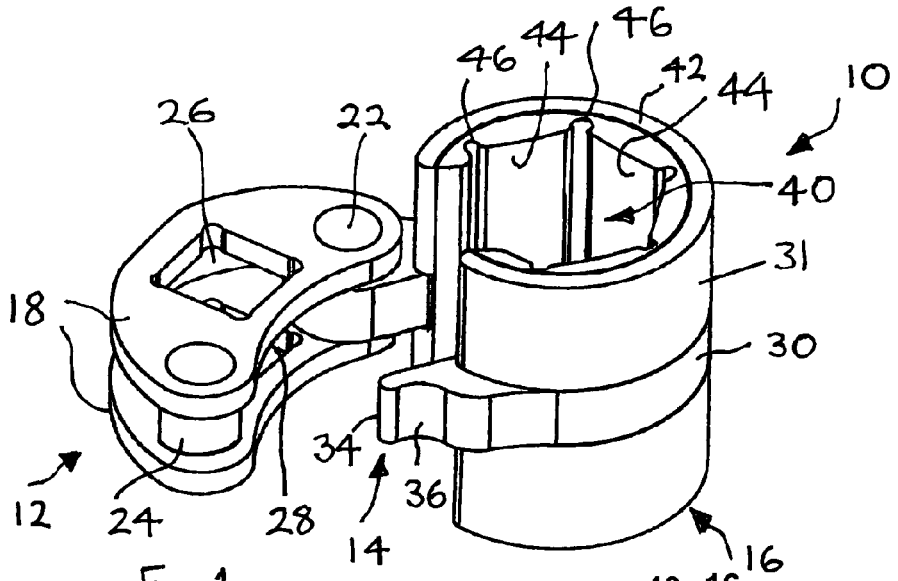
FIG. 1 is a perspective view showing a line wrench in an open condition.
Figure 2:
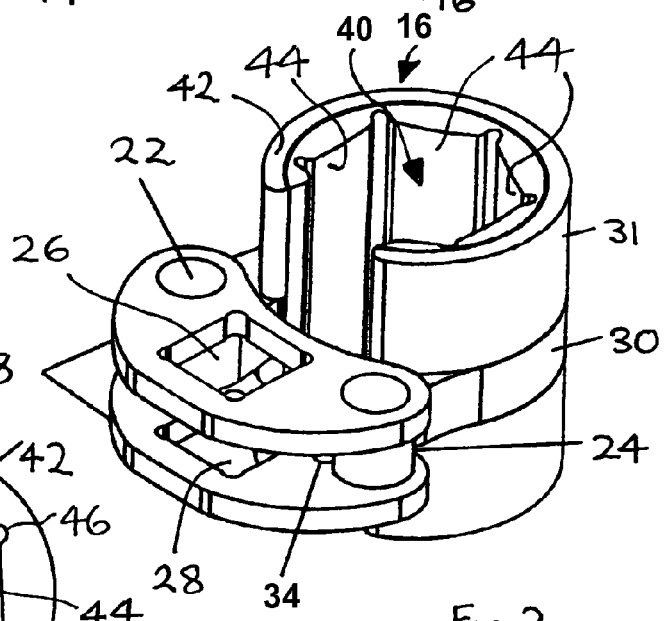
FIG. 2 is a perspective view showing the line wrench of FIG. 1 in a closed condition.
Figure 3:
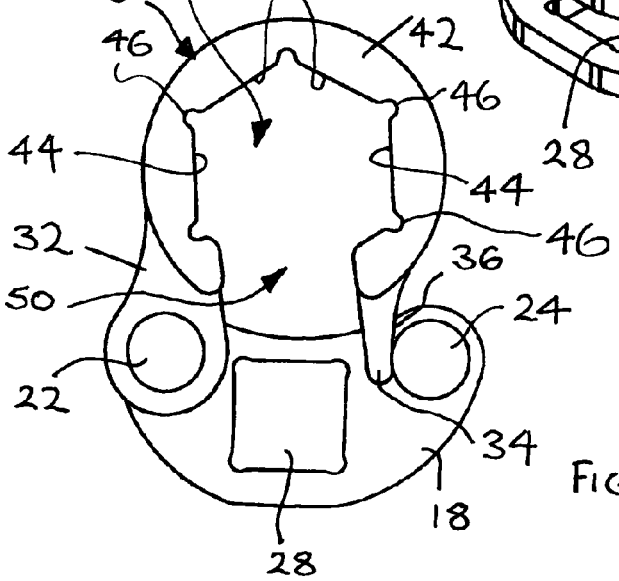
FIG. 3 is a plan view showing the line wrench of FIG. 1 in the closed condition and with a part of a drive receiving portion removed.

Referring to FIGS. 1 to 3, a line wrench 10 comprises a drive receiving portion 12, a holder in the form of a clamp portion 14 movably connected to the drive receiving portion and a fastener engaging body 16.

The drive receiving portion 12 comprises a pair of generally arcuate plates 18, which are held in generally parallel spaced relation by a pair of pins 22, 24. The pins 22, 24 are positioned at respective end regions of the plates 18 and extend generally parallel and perpendicular to the respective planes of the plates. The plates 18 are provided with respective generally centrally located through-holes 26, 28. The through-holes 26, 28 are shaped to receive a part (not shown) that is used to apply a drive force to the drive receiving portion 12. In this embodiment, the through-holes 26, 28 are generally rectangular for receiving a conventional drive member having a rectangular end fitted with one of more spring-loaded balls for releasably securing the drive member in the through-hole in a manner that will be known to those skilled in the art.

The clamp portion 14 comprises a generally C-shaped ring portion 30 that fits in a groove provided in the fastener engaging body 16 such that the outer surface of the ring portion is substantially flush with the outer surface 31 of the fastener engaging body. As best seen in FIG. 3, at one end, the ring portion 30 has a lug 32 provided with a through-hole that receives the pin 22 such that the clamp portion 14 can pivot about the pin. The opposite end of the clamp portion 14 defines a free end of the clamp portion and comprises a finger 34 provided with a camming surface 36. When the clamp portion 14 is pivoted from the open position shown in FIG. 1 to the closed position shown in FIG. 2, the camming surface 36 is moved into engagement with the pin 24, which functions as a cam member.

The fastener engaging body 16 is a generally cylindrical member having an axially extending fastener receiving aperture 40. The fastener receiving aperture 40 extends from one end 42 to the opposite end of the fastener engaging body 16. The fastener receiving aperture 40 is defined by a plurality of fastener engaging surfaces 44. The fastener engaging surfaces 44 are arranged for engaging a generally hexagonal fastener and are separated by arcuate recesses 46 that extend between the ends of the fastener engaging body 16 generally parallel to the axis of the fastener receiving aperture 40. As will be described below, the arcuate recesses 46 can function as hinges when the line wrench 10 is being used to apply a torque to a fastener.

The fastener engaging body 16 is provided with a side opening 50 that extends between the ends of the fastener engaging body and from the outer surface 31 through to the fastener receiving aperture 40. The side opening 50 has a width that is less than the 'across flats' width of the fastener receiving aperture 40. Thus a fastener the fastener receiving aperture is sized to receive cannot pass into the aperture through the side opening 50, but an elongate member (not shown), such as a brake pipe, fitted to such a fastener can enter the fastener receiving aperture through the side opening by a relative movement of the fastener engaging body and the elongate member that is transverse to the axis of the fastener receiving aperture. Although not essential, in this embodiment the width of the opening defined between the lug 32 and finger 34 of the clamp portion 14 is substantially equal to the width of the side opening 50.

Figure 6:
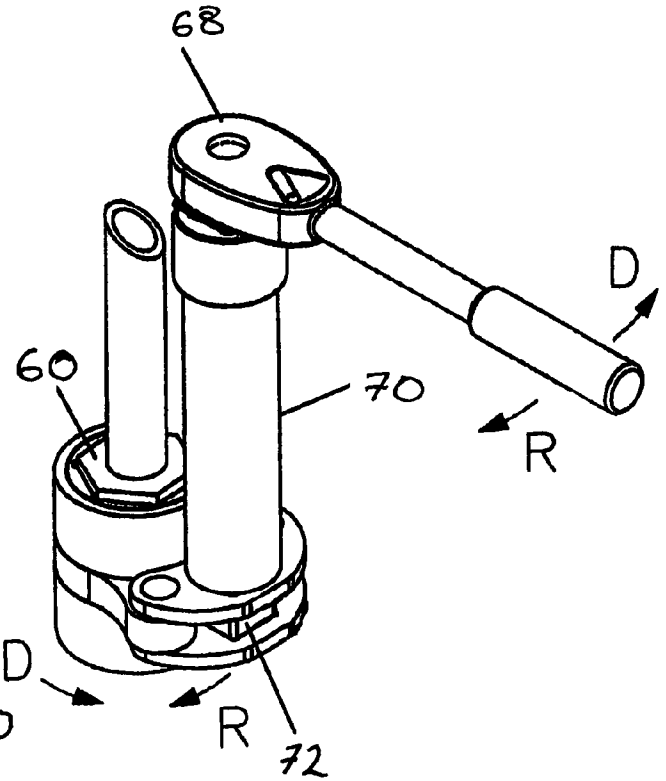
FIG. 6 is a view corresponding generally to FIG. 5 showing the line wrench being operated by a ratchet drive bar.
Figure 5:
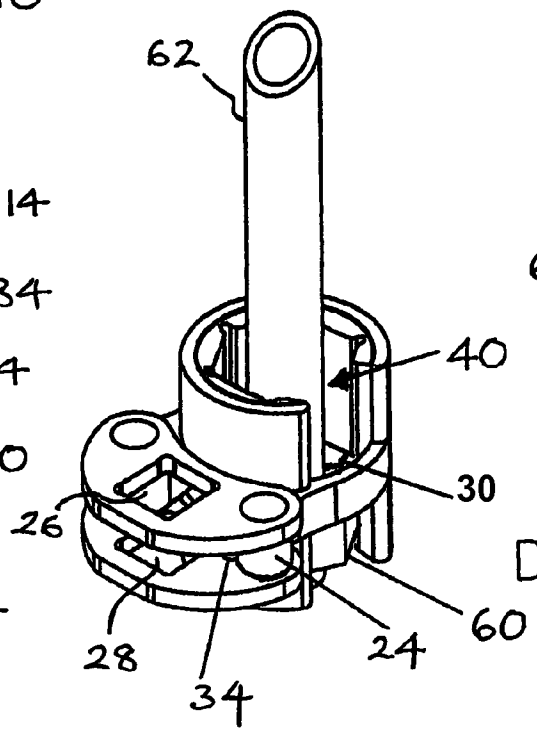
FIG. 5 is a view corresponding generally to FIG. 2 showing the line wrench in use.
Figure 4:
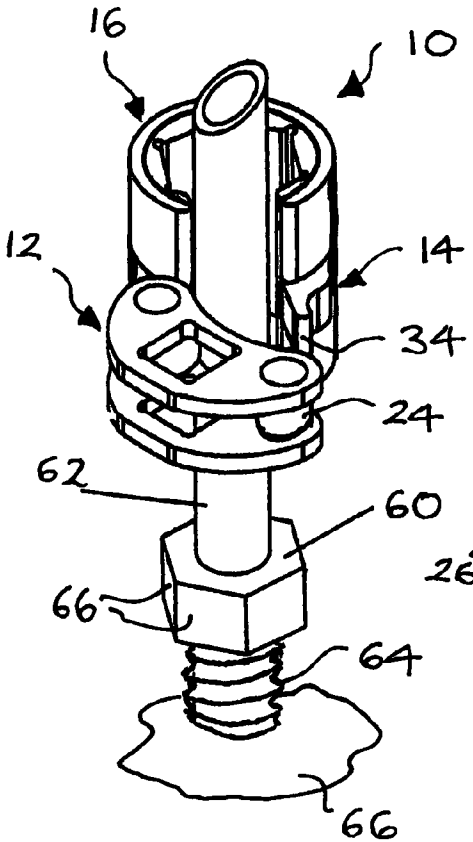
FIG. 4 is a view corresponding generally to FIG. 1 showing the line wrench in use on a flare nut on a fuel line.

Referring to FIGS. 4 to 6, the in line wrench 10 will now be described in use operating a flare nut 60 on a fuel pipe 62. In this example, the flare nut 60 is being used to secure the flared end of the fuel pipe 62 to a threaded male flare fitting 64 on a fuel injection metering unit 66. As will be known to those skilled in the art, the male flare fitting 64 has a through hole through which fuel can pass from the metering unit 66 into the fuel pipe 62 and a recess in its free end configured to mate with the flared end of the fuel pipe.

Referring to FIG. 4, the line wrench 10 is shown in an open condition in which the clamp portion 14 has been pivoted relative to the drive receiving portion 12 so as to move the finger 34 out of engagement with pin 24. In this position, by relative movement of the line wrench 10 and fuel pipe 62, the fuel pipe passes through the opening between the lug 32 and finger 34 into the side opening 50 (which is substantially aligned with the opening between the lug and finger) and on into the fastener receiving aperture 40. The relative movement of the line wrench 10 and fuel pipe 62 is in a direction transverse to the axis of the fastener receiving aperture 40 and the lengthways direction of the pipe. The relative movement may be substantially perpendicular to the axis of the fastener receiving aperture or include components perpendicular and parallel to the axis.

Once the fuel pipe 62 is received in the fastener receiving aperture 40, the drive receiving portion 12 is pivoted about the pin 22 to close the line wrench 10 by bringing the pin 24 into engagement with the finger 34. This is the condition shown in FIG. 5. The line wrench is then moved along the fuel pipe 62 until the flare nut 60 enters the fastener receiving aperture 40. In order for the flare nut 60 to slide into the fastener receiving aperture 40, it may be necessary to rotate the line wrench slightly to align the fastener engaging surfaces 44 with the flat drive receiving surfaces 66 of the flare nut.

Referring to FIG. 6, a ratchet drive bar 68 is shown connected to the line wrench 10 via an extension bar 70. The extension bar 70 has a rectangular drive spigot 72 that is received in the through holes 26, 28. By applying a torque to the handle of the ratchet drive bar 68 in the direction D, a rotational drive force is applied to the drive receiving portion 12 of the line wrench 10, which tends to turn the drive receiving portion towards the fastener engaging body 16. This presses the pin 24 against the finger 34. As the force acting on the drive receiving portion 12 increases, the pin 24 rises up the camming surface 36 towards the ring portion 30. This camming action progressively closes the circular aperture defined by the ring portion 30 clamping it progressively harder onto the fastener engaging body 16. When the clamping force is sufficient, the torque that is input by continued operation of the ratchet drive bar 68 is transmitted to the fastener engaging body 16 causing it to rotate the flare nut 60. The clamping action of the clamp portion 14 can be released by applying a torque to the handle of the ratchet drive bar 68 in the direction R. This causes the drive receiving portion 12 to pivot slightly away from the fastener engaging body 16 moving the pin 24 down the camming surface 36 towards the free end of the finger 34. Sufficient movement in this direction allows the clamp portion to rotate relative to the fastener engaging body 16 so that the drive receiving portion can be suitably repositioned prior to repeating the drive sequence to continue the tightening of the flare nut 60.

Once the flare nut 60 is sufficiently tightened, the line wrench 10 can be removed from the nut by applying a torque to the handle of the ratchet drive bar 68 to release the clamping force applied by the clamp portion 14 and then reversing the procedure described with reference to FIGS. 4 to 6.

If the operator wishes to use the line wrench 10 to release the flare nut 60, all that is needed is to fit the wrench to the nut the opposite way up so that as viewed in FIG. 4, the through hole 28 is the uppermost of the two through holes.

Figure 7:
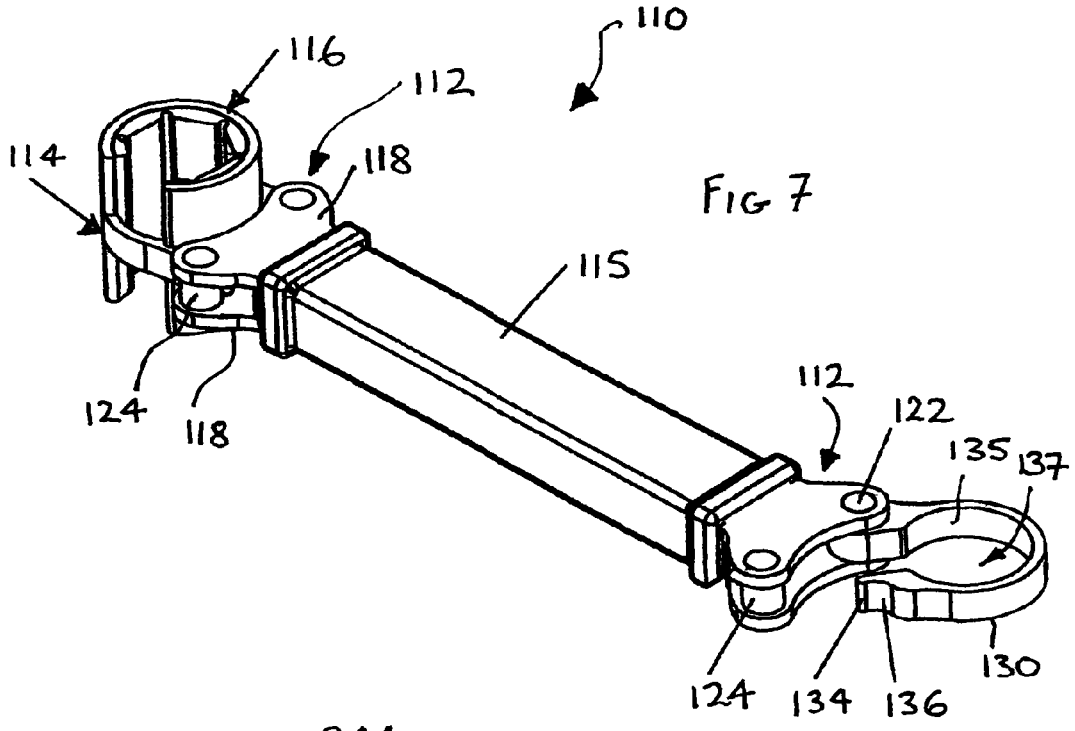
FIG. 7 is a perspective view of another line wrench.

FIG. 7 shows another line wrench 110. Many features of the line wrench 10 are common to the line wrench 110. To avoid repetition of description of parts of the line wrench 110 that are the same as or similar to parts of the line wrench 10, such parts are labelled with the same reference numeral incremented by 100.

The line wrench 110 comprises a pair of drive receiving portions 112 fitted to opposite ends of a handle 115. The handle 115 replaces the ratchet drive bar 68 shown of FIG. 6 as a means for inputting a drive torque to the line wrench and so the drive receiving portions 112 do not have through holes corresponding to the through holes 26, 28 shown in FIG. 2. Otherwise, the drive receiving portions 112 correspond to the drive receiving portion 12. In particular the drive receiving portions comprise spaced apart plates 118 and pins 122, 124. The clamp portion 114 and fastener engaging body 116 correspond to the parts 14 and 16.

The line wrench 110 is operated in exactly the same way as the line wrench 10, except that the handle 115 is used in place of the ratchet drive bar 68.

Figure 8:
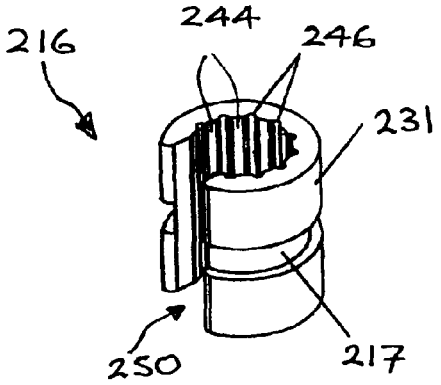
FIG. 8 shows an alternative fastener engaging body for the line wrenches of FIGS. 1 to 6 and 7.

FIG. 8 shows a fastener engaging body 216 that can be used with the line wrench 10 or line wrench 110 in place of the fastener engaging bodies 16, 116. The fastener engaging body 216 is a cylindrical body and is provided with a circumferentially extending groove 217 in the outer surface 231 of the body. The groove 217 is for receiving the ring portion 30, 130 of the line wrench. As can be seen in FIG. 7, the ring portion 130 has a curved inner wall 135 (the ring portion 30 has a corresponding wall that is not shown in the drawings), which defines a circular aperture 137 that receives the narrowed portion of the fastener engaging body 216 defined by the groove 217. In the same way as the fastener engaging bodies 16, 116, the fastener engaging body 216 has a side opening 250 through which an elongate member such as the fuel pipe 62 can enter the fastener receiving aperture.

The fastener engaging body 216 differs from the fastener engaging bodies 16, 116 in that it has a greater number of fastener engaging surfaces 244 separated by respective arcuate recesses 246.

Figure 9:
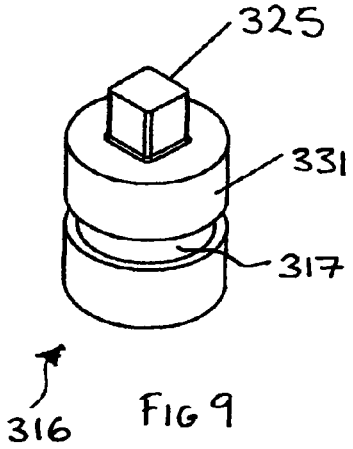
FIG. 9 is a perspective view of a drive fitting for converting the line wrench of FIG. 7 into a drive bar.

FIG. 9 shows a drive fitting 316 that can be fitted in the clamp portion 114 in place of a fastener engaging body. The drive fitting 316 is a cylindrical body having an outer surface 331 provided with a groove 317 such that it can be fitted into the clamp portion 114 in exactly the same way as a fastener engaging body 116, 216. However, instead of having a fastener receiving aperture, the drive fitting 316 is a solid body provided with an axially extending male drive spigot 325. This allows the line wrench 110 to additionally function as a ratchet bar substitute. By applying a torque in the drive direction to the handle 115, the line wrench 110 can be operated such that the drive fitting is clamped by the clamp portion 114 and a torque applied to the drive fitting to turn a part engaged by the male drive spigot 325. The clamp portion 114 can then be relaxed to allow rotation relative to the drive fitting 316 by applying a toque to the handle in the direction opposite to the drive direction. Once the handle 115 and clamp portion 114 have been suitable repositioned relative to the drive fitting 316, a torque is again applied in the drive direction to cause clamping of the drive fitting and the application of a torque to the drive fitting to again turn the part engaged by the male spigot 325. It will be appreciated that by repeating these processes alternately, a substitute ratchet action is obtained.

Figure 10:
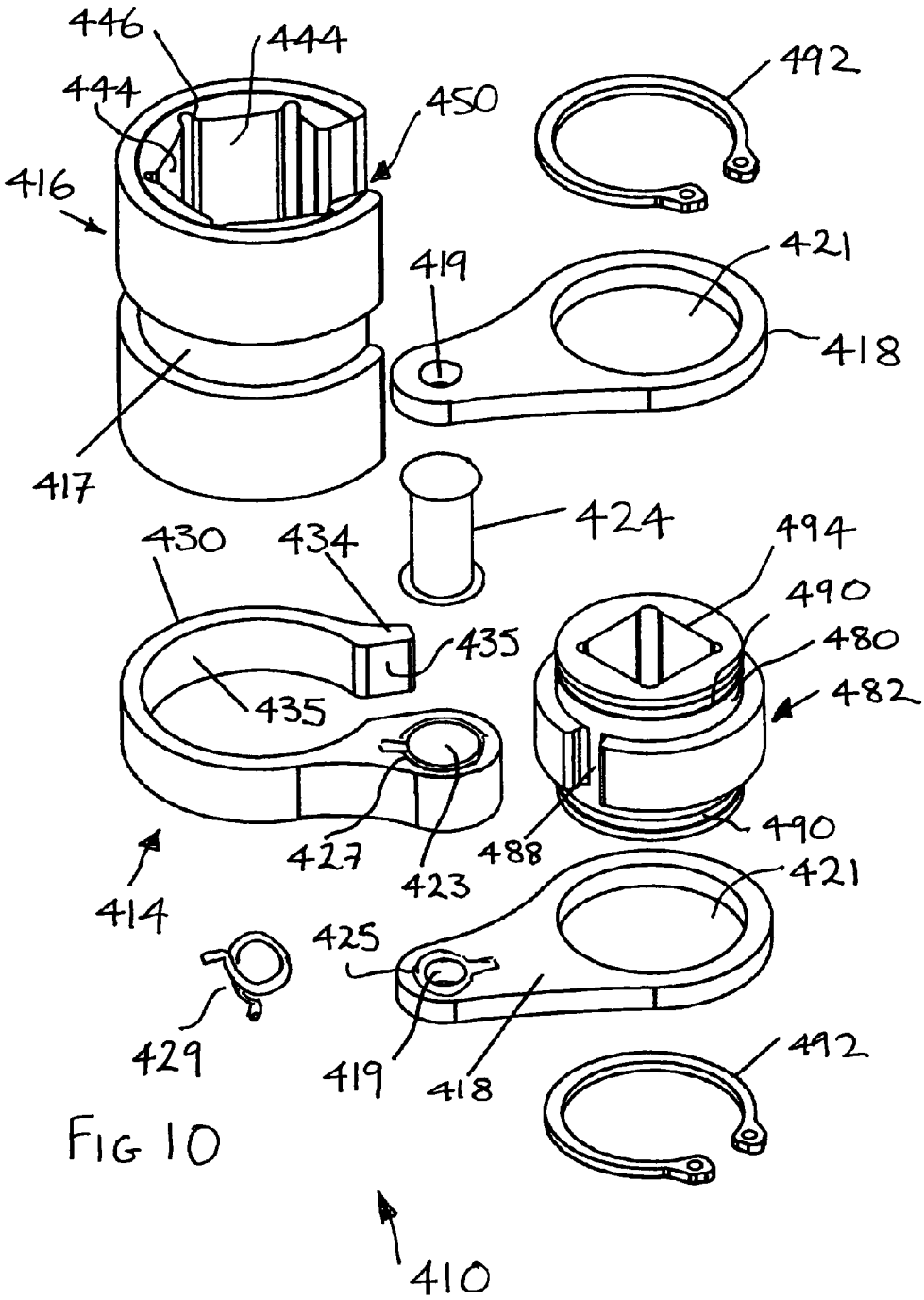
FIG. 10 is an exploded perspective view of yet another line wrench.

A line wrench 410 that is a modification of the line wrench 10 will now be described with reference to FIGS. 10 and 11. Many features of the line wrench 10 are common to the line wrench 410. To avoid repetition of description of parts of the line wrench 410 that are the same as or similar to parts of the line wrench 10, such parts are labelled with the same reference numeral incremented by 400.

The clamp portion 414 and fastener engaging body 416 of the line wrench 410 correspond essentially to the like parts of the line wrench 10 and so no further description is required. However, the drive receiving portion 412 differs from the drive receiving portion 12. The drive receiving portion 412 comprises a pair of opposed parallel spaced apart plates 418. The plates 418 have respective apertures 419, 421 at opposite end regions thereof. A pin 424 is fitted in the apertures 419 and through an aperture 423 in the lug 432 of the clamp portion 414 such that the clamp portion can pivot about the pin relative to the drive receiving portion 412. The plates 418 and the respective facing portions of the lug 432 are provided with respective grooves 425, 427 that overlie one another when the lug is fitted between the plates 418. Each pair of grooves 425, 427 houses a spring 429. As described in more detail below, the springs 429 are arranged to bias the line wrench 410 to a closed position.

The apertures 421 are larger than the apertures 419 and serve as bushes for respective bearing portions 480 of a rotatable gear member 482. The bearing portions 480 are situated on either side of a toothed section of the gear member 482. As best seen in FIG. 11, the toothed section is provided with teeth 484 that extend generally parallel to the axis of rotation of the gear member 482. The teeth 484 are provided at equi-spaced intervals around the circumference of the toothed section and are separated by recesses 488. Axially outwardly of each of the bearing portions 480, the gear member 482 is provided with respective circumferentially extending grooves 490 for receiving respective circlips 492. As can be seen in FIG. 11, when the gear member 482 is assembled between the plates 418, the circlips 492 are fitted in the grooves 490 to secure the plates and maintain the bearing portions 480 in the apertures 421 while allowing sufficient freedom of movement for the gear member to rotate relative to the plates 418. The gear member 482 has an axially extending through hole 494. The through hole 494 has a generally rectangular cross section for receiving a rectangular drive member by means of which a drive torque can be applied to the gear member 482.

Figure 11:
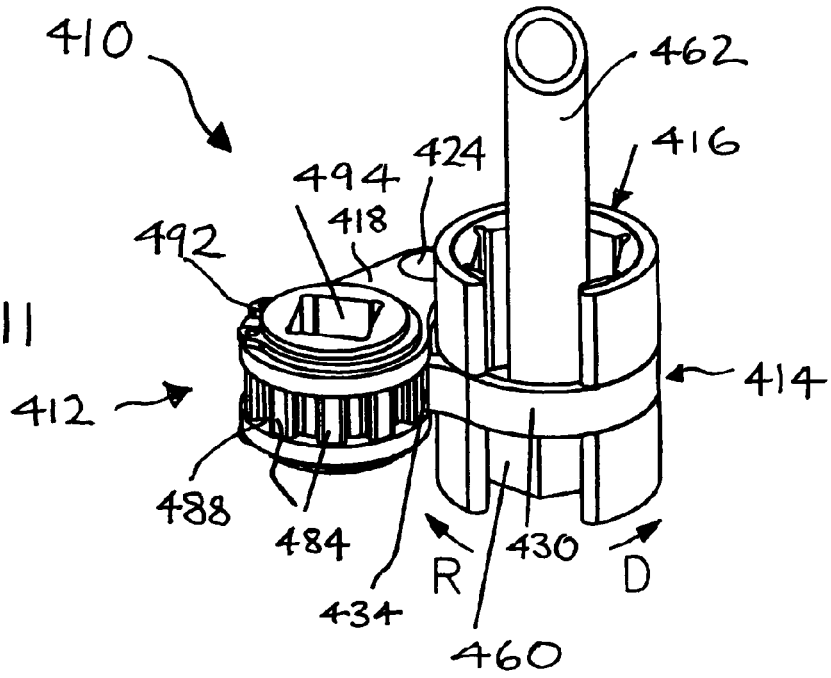
FIG. 11 is a perspective view showing the line wrench of FIG. 10 fitted on a flare nut.

Referring to FIG. 11, the line wrench 410 can be fitted onto a flare nut 460 in exactly the same way as the line wrench 10 shown in FIGS. 4 and 5 except that the closing of the wrench comprises fitting the finger 434 of the clamp portion 414 into one of the recesses 488 between the teeth 484. The action of the springs 429 is to bias the clamp portion 414 and drive receiving portion 412 towards one another such that the wrench is self-closing and the finger 434 is pressed into the recess 488. A drive input device, for example a ratchet drive bar 68 and extension bar 70 as shown in FIG. 6, is connected to the line wrench 410 via the through hole 494 of the gear member 482. Rotation of the gear member 482 by a torque in the direction D input by the drive input device presses a tooth 484 on one side of the recess 488 in which the finger 434 is received against the finger causing the clamp portion 414 to clamp onto and apply a torque to the fastener engaging body 416. If the drive input device is used to apply a torque in the direction R, the tooth 484 on the opposite side of the recess 488 in which the finger 434 is received will press against the inside 435 of the finger to open the clamp portion 414. Once the clamp portion 414 has opened sufficiently, the drive receiving portion 412 and clamp portion can be rotated around the fastener engaging body 416 to bring them into a position at which further torque can be applied in the direction D to continue tightening of the flare nut 460. When the flare nut 460 has been tightened sufficiently, the clamp portion 414 is released by applying a torque in the direction R and then the operator pivots the drive receiving portion 412 away from the clamp portion 414 to disengage the finger 434 from the gear member 482. The operator then moves the line wrench 410 in the lengthways direction of the fuel pipe 462 to disengage the fastener engaging body 416 from the flare nut 460. The opening between the lug 432 and finger 434 of the clamp portion 414 is then aligned with the side opening 450 of the fastener engaging body 416 to allow the fuel pipe 462 to pass through the openings and completely disengage the line wrench 410 from the pipe.

A line wrench 510 will now be described with reference to FIGS. 12 to 15. Many features of the line wrench 10 are incorporated in the line wrench 510. To avoid repetition of description of parts of the line wrench 510 that are the same as or similar to parts of the line wrench 10, such parts are labelled with the same reference numeral incremented by 500.

The line wrench 510 comprises a drive receiving portion 512, a holder or clamp portion 514 pivotally connected to the drive receiving portion and a fastener engaging body 516. In FIG. 13 a plate 518 of the drive receiving portion 512 is shown removed to reveal internal features of the closed line wrench. Similarly, in FIG. 14, an outer plate of the clamp portion 514 has been removed to show features of a ratchet mechanism of the line wrench 510.

In this embodiment, the drive receiving portion 512 comprises a pair of plates 518 that are connected to one another and maintained in parallel spaced relation by a plurality of pins 524 that extend between the plates generally perpendicular to the plane of the plates. One of the pins 524 extends through a lug 532 of the clamp portion 514 to pivotally connect the clamp portion to the drive receiving portion 512. The arrangement is such that the drive receiving portion 512 and clamp portion 514 can pivot relative to one another so as to be pivotable between the open condition shown in FIG. 12 and the closed condition shown in FIGS. 13 and 14. The plates 518 of the drive receiving portion 512 are provided with respective generally rectangular through holes 526, 528 for receiving and mating with a generally rectangular male spigot of a drive input device or extension member of a drive input device.

The fastener engaging body 516 is a cylindrical body having an axially extending fastener receiving aperture 540 that extends between the opposed ends of the cylindrical body. The fastener engaging body 516 has a side opening 550 arranged to allow an elongate member, such as a pipe, having length greater than the length of the cylindrical body to be pass into the fastener receiving aperture 540 by virtue of a relative movement of the pipe and fastener engaging body that is transverse to the axis of the fastener engaging body and the lengthways direction of the pipe. As shown in FIG. 15, the fastener engaging body 516 is provided with a circumferentially extending rib 600 in which a series of equi-spaced ratchet teeth 602 are defined. The rib 600 extends fully around the fastener engaging body 516 between the opposite sides of the side opening 550. As shown in FIG. 14, the teeth 602 are inclined with respect to the radial direction of the fastener engaging body 516.

Figure 12:
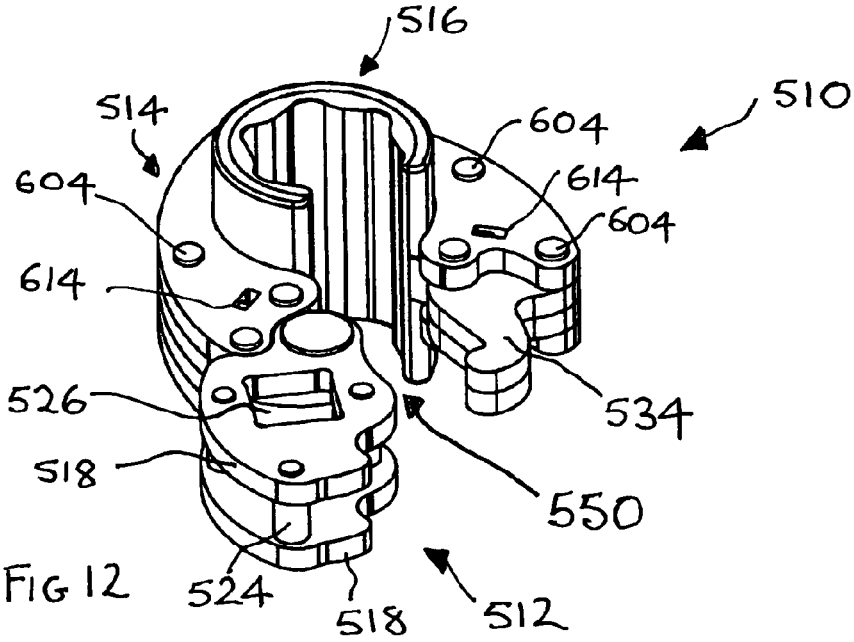
FIG. 12 is a perspective view showing still another line wrench in an open condition.

As shown in FIG. 12, the clamp portion 514 of this embodiment is a laminate structure comprising four stacked plates that are held together by rivets 603. The two inner plates extend generally circumferentially beyond the two outer plates to form the lug 532 and finger 534 of the clamp portion 514. As shown in FIG. 14, the inner plates also define two recesses that house respective detents 604.

Referring to FIG. 16, the detents 604 comprise a nose 606 that has a leading end 608. The leading end 608 is inclined in the widthways direction of the detent so as to be able to mate with the teeth 602 of the fastener engaging body 516. The detents 604 additionally comprise an integral spring section comprising convolutions 610 that can compress to store energy for biasing the nose 606 into engagement with the teeth 602. Adjacent the connection between the nose 606 and spring section convolutions 610, the detents 604 are provided with a tab 612. The tabs 612 are received in respective apertures 614 provided in the uppermost (as viewed in FIGS. 12 and 13) plate of the clamp portion 514. Engagement between a tab 612 and the opposite ends of the aperture 614 in which it is received serves to limit the range of movement of the nose 606.

Referring to FIG. 14, it can be seen that the detents 604 are located on opposite sides of the clamp portion 514 adjacent the opening defined between the lug 532 and finger 534. It can also be seen that the detents 604 are positioned so as to be out of phase such that when one is engaged between adjacent teeth 602 (see the righthand detent in FIG. 14), the other is positioned on the crest of a tooth 602. As the clamp portion 514 rotates relative to the fastener engaging body 516 the detents 604 will alternately engage between adjacent teeth 602 and rest on the crest of a tooth. This out of phase arrangement allows a fine ratchet movement to be provided without compromising the strength of the teeth. It will be appreciated that in order to provide finer movements with a conventional ratchet mechanism, the pitch of the teeth has to be reduced, which means the teeth have to be made relatively smaller. This impacts on the strength of the ratchet mechanism and so the design of a conventional ratchet mechanism in a wrench is a compromise between the fineness of the desired movement and the torque the ratchet mechanism is required to transmit. Due to the out of phase arrangement of the detents 604, the clamp portion will ratchet around the fastener engaging body 516 in increments approximating to half the pitch of the teeth. Thus, for example, for a tooth pitch providing 6° of rotation per ratchet movement, the ratchet movement will be reduced to approximately 3°. This allows the provision of a fine ratchet movement with a relatively coarser, stronger, tooth form than a conventional ratchet mechanism.

In use, the line wrench 510 is fitted onto a fastener in generally the same way as the line wrench 10. In this embodiment, the finger 534 is configured such that when the line wrench is in the closed position, one side extends around at least a portion of two sides of the periphery of the through holes 526, 528 and the opposite side wraps around a portion of the periphery of one of the pins 524 (see FIG. 13). The arrangement is such that when a male drive spigot is fitted into the through holes 526, 528 it will lock the line wrench in the closed position by substantially preventing relative pivoting movement of the drive receiving portion 512 and clamp portion 514. With the line wrench 510 thus clamped in place on the fastener, the application of an input drive torque by an input device such as a ratchet drive bar in the drive direction D (FIG. 13) is transmitted from the drive receiving portion to the clamp portion 514 and from the clamp portion to the fastener engaging portion 516 via the ratchet mechanism. If the drive receiving portion 512 and clamp portion 514 need to be repositioned on the fastener engaging body 516 during tightening of a fastener, they can be ratcheted around the fastener engaging body by applying a torque in the direction R.

When the tightening process is complete, line wrench 510 is first moved in the axial direction of the fastener engaging body 516 along the pipe to disengage the fastener engaging body from the fastener. The male drive spigot is then removed from the through holes 526, 528 to unlock the line wrench and allow the drive receiving portion 512 to be pivoted away from the clamp portion 514 to open the wrench so that the pipe can pass through the side opening 550 and the opening between the lug 532 and finger 534.

In the description of the embodiments, the line wrenches have been described in use operating a flare nut on a fuel pipe. It will be appreciated that this is not to be taken as limiting and the line wrenches have many applications. For example, the line wrenches can be used to operate a fastener incorporated in hydraulic line such as a brake line, a fastener incorporated in an electrical line or a fastener incorporated in a water supply line such as a line in a heating or other air conditioning system. It will also be understood that while the line wrenches are particularly suited to operating fasteners incorporated in a line, they can be used to operate fasteners generally.

It will be understood that the different configurations of the fastener receiving aperture in the embodiments are given by way of example only and that the fastener receiving aperture can be configured to mate with the particular form of fastener the fastener engaging body is intended to operate.

It will also be appreciated that because the line wrenches are essentially one way drives, the fastener receiving aperture can be made to fit near sized Imperial and metric sized fasteners. The provision of arcuate recesses between the fastener engaging faces as shown in FIGS. 1, 8, 10 and 13 provides a degree of flexibility to the fastener engaging body. Specifically, the recesses function in the manner of a hinge so that the fastener engaging body can flex and grip near size or damaged fasteners (for example, fasteners with fastener engaging surfaces that have are somewhat rounded in the drive applying direction). The acrucate corners also reduce the likelihood of stress cracks forming in the fastener engaging body as it flexes in response to an applied torque.

It will be appreciated that the line wrenches 10, 110, 410 can be used with various known extension bars and drive bars, including ratchet drive bars, to operate difficult to access fasteners that are fitted singly or in groups.

In embodiments such as the line wrenches 10, 110 and 410, the resilience of the clamp portion may be sufficient to allow the fastener engaging body to be engaged by snap-fitting such that fastener engaging bodies with different sized and/or shaped fastener receiving aperture can be fitted to the wrench. The resilience of the clamp portion will also typically be sufficient to ensure the fastener engaging body remains fitted in the clamp portion, particularly when in use in remote locations in which the operator cannot hold the fastener engaging body in place.

Although the line wrench is preferably used with a fastener engaging body, the clamp portion of the line wrenches 10, 110 and 410 can be used directly on cylindrical objects such as pipes, the resilience of the clamp portion permitting the opening between the lug and finger to open sufficiently to allow the cylindrical object to enter the aperture defined by the clamp portion.

As illustrated in FIGS. 13 to 15, the fastener engaging body may be provided with fastener engaging faces configured to engage the drive 'half' of the fastener drive surfaces.

The invention claimed is:

1. A line wrench comprising:

a drive receiving portion;

a clamp portion movably connected to said drive receiving portion; and a fastener engaging body, wherein said fastener engaging body has a plurality of fastener engaging surfaces defined by a fastener receiving aperture having an axis and a side opening through which an elongate member can enter said fastener receiving aperture by a movement transverse to said axis;

wherein said clamp portion is arranged to receive said fastener engaging body such that said clamp portion can rotate relative to the fastener engaging body, wherein said clamp portion has a free end portion and is movable between a position in which said free end portion is spaced from said drive receiving portion to permit said elongate member to enter said side opening and a position in which said free end portion engages said drive receiving portion such that, when a drive torque is applied to said drive receiving portion in a drive direction, said fastener engaging body is clamped by said clamp portion for transferring said drive torque to said fastener engaging body to apply said drive torque to a fastener engaged by said fastener engaging body, and wherein, when a torque is applied to said drive receiving portion in a direction opposite said drive direction, the clamp portion releases said fastener engaging body to permit said rotation relative to the fastener engaging body to permit repositioning of the drive receiving portion relative to the fastener engaging body while the fastener engaging body remains in engagement with said fastener.

2. A line wrench as claimed in claim 1, wherein said clamp portion is pivotally connected to said drive receiving portion.

3. A line wrench as claimed in claim 1, wherein said clamp portion is provided with a camming surface for cooperably engaging said drive receiving portion such that said drive torque applied to said drive receiving portion is transmitted to said clamp portion via said camming surface for providing a progressively increasing clamping force to said fastener engaging body.

4. A line wrench as claimed in claim 1, wherein said drive receiving portion comprises a movable toothed member for transmitting said drive torque applied to said drive receiving portion to said clamp portion to cause a clamping force to be applied to said fastener engaging body.

5. A line wrench as claimed in claim 4, wherein said clamp portion has a free end arranged to mesh with said toothed member.

6. A line wrench as claimed in claim 1, wherein one of said fastener engaging body and said clamp portion is provided with ratchet teeth and the other of said fastener engaging body and said clamp portion is provided with at least one pawl for engaging said ratchet teeth for transmitting said drive torque from said clamp portion to said fastener engaging body.

7. A line wrench as claimed in claim 6, comprising a first pawl and a second pawl, said first and second pawls being arranged such that when one engages between two adjacent ratchet teeth the other is generally in line with a ratchet tooth.

8. A line wrench as claimed in claim 7, wherein said pawls comprise an integral biasing structure for biasing said pawls into engagement with the ratchet teeth.

9. A line wrench as claimed in claim 1, wherein said fastener engaging body comprises a formation interengageable with a cooperating formation of said clamp portion to assist in retaining said fastener engaging body in said clamp portion when said line wrench is in an open condition.

10. A line wrench comprising:

a drive receiving portion;

a holder movably connected to said drive receiving portion;

a fastener engaging body, wherein said fastener engaging body has a plurality of fastener engaging surfaces defined by a fastener receiving aperture having an axis and a side opening through which an elongate member can enter said fastener receiving aperture by a movement transverse to said axis;

wherein said holder is arranged to receive said fastener engaging body such that said holder can rotate relative to the fastener engaging body, and wherein said holder has a free end portion and is movable between a position in which said free end portion is spaced from said drive receiving portion to permit said elongate member to enter said side opening and a position in which said free end portion engages said drive receiving portion such that a drive torque applied to said drive receiving portion is transmitted to said holder via said free end portion to cause said holder to clamp said fastener engaging body to transmit said drive torque to said fastener engaging body to apply said drive torque to a fastener engaged by said fastener engaging body, and wherein, when a torque is applied to said fastener engaging body in a direction opposite to said drive torque, the holder releases the fastener engaging body to permit said rotation relative to the fastener engaging body to permit repositioning of said drive receiving portion relative to said fastener engaging body while said fastener engaging body remains in engagement with said fastener.

11. A line wrench as claimed in claim 10, wherein said holder comprises a resilient member that is resilient deformable by said transmitted drive torque to cause it to grip said fastener engaging body and transmit said drive torque to said fastener engaging body by frictional engagement with said fastener engaging body.

12. A line wrench as claimed in claim 10, wherein one of said holder and said fastener engaging body is provided with ratchet teeth and the other of said holder and said fastener engaging body is provided with at least one pawl for engaging said ratchet teeth, said drive force being transmitted from said holder to said fastener engaging body by engagement between said at least one pawl and said ratchet teeth.

13. A line wrench as claimed in claim 12, comprising a ratchet mechanism comprising a plurality of pawls that engage said ratchet teeth out of phase such that each ratchet movement of said ratchet mechanism equals a tooth pitch of said ratchet teeth divided by the number of said pawls.

14. A line wrench as claimed in claim 13, wherein said plurality of pawls comprises two pawls, whereby said ratchet movement is equal to half the tooth pitch.

* * * * *